US007601080B2

(12) United States Patent
Olson et al.

(10) Patent No.: US 7,601,080 B2
(45) Date of Patent: Oct. 13, 2009

(54) GOLF BALL DIMPLES WITH SPIRAL DEPRESSIONS

(75) Inventors: Traci L. Olson, Westport, MA (US); Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 154 days.

(21) Appl. No.: 11/738,755

(22) Filed: Apr. 23, 2007

(65) Prior Publication Data

US 2008/0261725 A1 Oct. 23, 2008

(51) Int. Cl.
*A63B 37/12* (2006.01)

(52) U.S. Cl. ..... 473/384

(58) Field of Classification Search ..... 473/383–385; D21/708–709

See application file for complete search history.

(56) References Cited

U.S. PATENT DOCUMENTS

| | | | | | |
|---|---|---|---|---|---|
| 44,175 | A | * | 9/1864 | Martin et al. | 126/9 R |
| 44,176 | A | * | 9/1864 | Martin et al. | 280/11.14 |
| 44,177 | A | * | 9/1864 | Martin et al. | 159/34 |
| D44,175 | S | * | 6/1913 | Martin et al. | D21/708 |
| D44,176 | S | * | 6/1913 | Martin et al. | D21/708 |
| D44,177 | S | * | 6/1913 | Martin et al. | D21/708 |
| 4,787,638 | A | | 11/1988 | Kobayashi | |
| 5,005,838 | A | | 4/1991 | Oka | |
| 5,957,787 | A | | 9/1999 | Hwang | |
| 6,059,671 | A | | 5/2000 | Asakura | |
| 6,162,136 | A | * | 12/2000 | Aoyama | 473/383 |
| 6,176,793 | B1 | | 1/2001 | Sullivan et al. | |
| 6,368,238 | B1 | | 4/2002 | Kasashima et al. | |
| 6,475,106 | B1 | | 11/2002 | Green et al. | |
| 6,478,698 | B2 | | 11/2002 | Melvin et al. | |
| 6,503,158 | B2 | | 1/2003 | Murphy et al. | |
| 6,547,678 | B2 | | 4/2003 | Barfield | |
| 6,569,038 | B2 | | 5/2003 | Sullivan | |
| 6,663,511 | B2 | | 12/2003 | Sullivan | |
| 6,749,525 | B2 | | 6/2004 | Aoyama | |
| 6,890,272 | B2 | | 5/2005 | Sullivan | |
| 6,958,020 | B1 | | 10/2005 | Ogg et al. | |
| D516,641 | S | * | 3/2006 | Lee et al. | D21/709 |
| 7,090,593 | B2 | | 8/2006 | Sullivan | |

* cited by examiner

*Primary Examiner*—Raeann Trimiew
(74) *Attorney, Agent, or Firm*—D. Michael Burns

(57) ABSTRACT

A golf ball includes a spherical outer surface and a plurality of dimples formed thereon. The dimples have an inner land surface with at least one spiral depression either disposed or superimposed on the inner land surface to energize or agitate the airflow over the dimpled surfaces to increase the aerodynamic performance of the golf ball. The spiral depression may turn clockwise or counterclockwise and can be either spaced apart, touching or overlapping each other. While the dimples may be circular, polygonal, triangular or elliptical, dimples having a cross section greater than 0.18 inch are preferred. The dimples may also comprise spiral depressions directly on the spherical surface of the ball.

2 Claims, 4 Drawing Sheets

GOLF BALL DIMPLES WITH SPIRAL DEPRESSIONS

FIELD OF THE INVENTION

The present invention relates to golf balls, and more particularly, to golf balls that have dimples which contain spiral depressions or are a product of spiral depressions directly on the surface of the ball.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities and thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, there is a reduction in the area of the wake, an increase in the pressure behind the ball, and a substantial reduction in drag. It is the circumference portion of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference portion of each dimple is important in optimizing this flow phenomenon, as well.

By using dimples to decrease drag and increase lift, every golf ball manufacturer has increased their golf ball flight distances. In order to optimize ball performance, it is desirable to have a large number of dimples, hence a large amount of dimple circumference, which is evenly distributed around the ball. In arranging the dimples, an attempt is made to minimize the space between dimples, because such space does not improve aerodynamic performance of the ball. In practical terms, this usually translates into 300 to 500 circular dimples with a conventional-sized dimple having a diameter that ranges from about 0.110 inches to about 0.180 inches.

When compared to a given number of conventional-size dimples, theoretically, an increased number of small dimples could create greater aerodynamic performance by increasing total dimple circumference. However, in reality small dimples are not always very effective in decreasing drag and increasing lift. This results at least in part from the susceptibility of small dimples to paint flooding. Paint flooding occurs when the paint coat on the golf ball partially fills the small dimples, and consequently decreases their aerodynamic effectiveness. On the other hand, a smaller number of large dimples also begins to lose effectiveness. This results from the total circumference of a given number of large dimples being less than that of an alternative group of smaller dimples.

U.S. Pat. No. 4,787,638 teaches the use of grit blasting to create small craters on the undimpled surface of the ball and on the surface of the dimples. Grit blasting is known to create a rough surface. The rough surface on the land surface of the ball may decrease the aesthetic appearance of the ball. Furthermore, these small craters may be covered by paint flooding. U.S. Pat. Nos. 6,059,671, 6,176,793 B1 and 5,005,838 disclose dimples that have smooth irregular dimple surfaces. These smooth irregular dimple surfaces, however, might not efficiently energize the boundary layer flow over the dimples.

One approach for maximizing the aerodynamic performance of golf balls is suggested in U.S. Pat. No. 6,162,136 ("the '136 patent), wherein a preferred solution is to minimize the land surface or undimpled surface of the ball. The '136 patent also discloses that this minimization should be balanced against the durability of the ball. Since as the land surface decreases, the susceptibility of the ball to premature wear and tear by impacts with the golf club increases. Hence, there remains a need in the art for a more aerodynamic and durable golf ball.

SUMMARY OF THE INVENTION

Accordingly, the present invention is directed to a golf ball with improved depressions, whether the depressions being directly on the surface of the ball or within the confines of land area in the concave surface of a dimple. The present invention is also directed to a golf ball with improved aerodynamic characteristics. These and other embodiments of the prevent invention are realized by a golf ball comprising a spherical outer land surface and a plurality of dimples or depressions formed thereon. Each depression, whether on the ball surface or within the confines of a dimple, comprise at least one spiral structure to promote the energizing of the aerodynamic boundary layer over the contour surface of the ball. The un-dimpled land surface, therefore, remains robust to prevent premature wear and tear. The dimples can have a myriad of shapes and sizes and may be distributed in any pattern, concentration or location.

The spiral depressions may turn in either a clockwise or a counterclockwise direction, and individual revolutions may be spaced apart from each other or may touch or overlap. While the spiral concept may be advantageous to other dimple sizes, it is preferred that the dimples be at least 0.18 inch in diameter.

In one embodiment the spiral depressions are superimposed upon the inner surface and may include a plurality of spirals and a plurality of turns.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
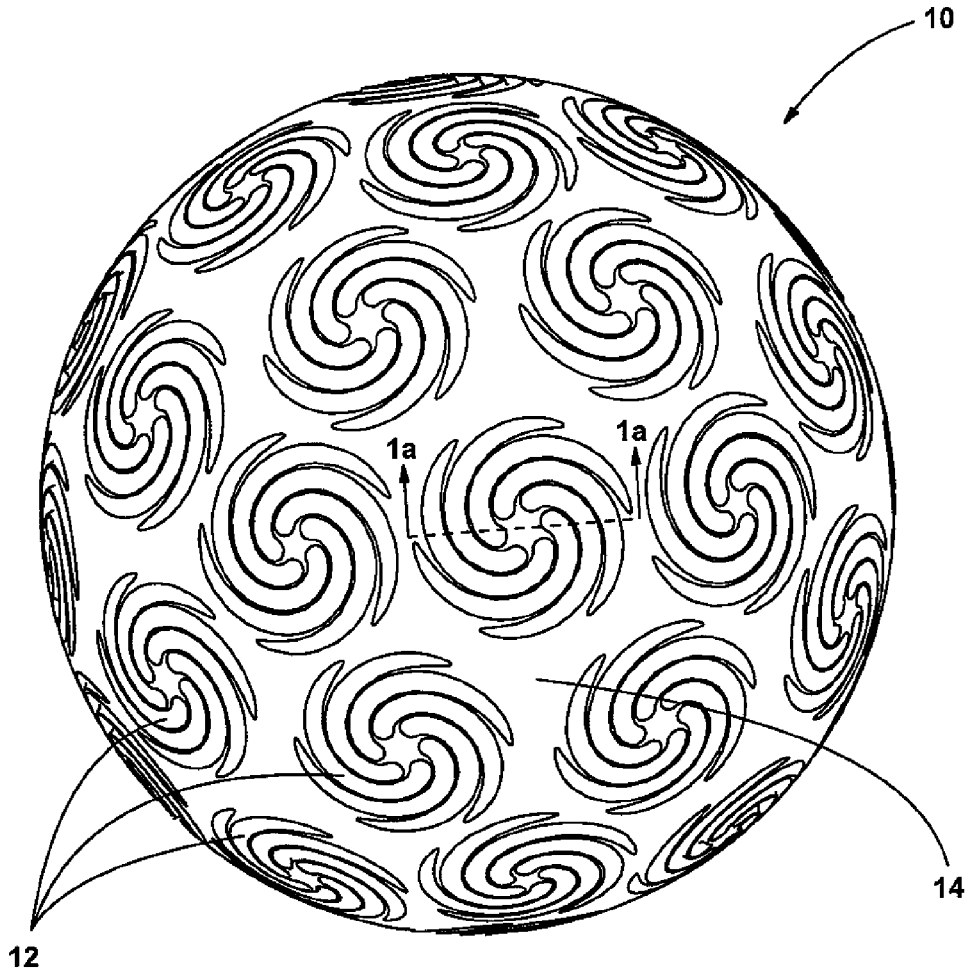
FIG. 1 is a front view of a preferred embodiment of a golf ball in accordance to the present invention.
Figure 1A:
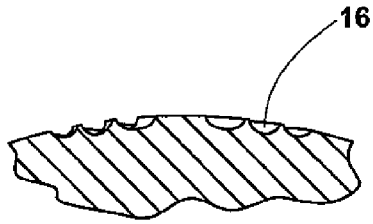
FIG. 1*a* is a cross-sectional view along line 1*a*-1*a* of FIG. 1.

As shown generally in FIGS. 1, and 1*a*, where like numbers designate like parts, reference number 10 broadly designates a golf ball 10 having a plurality of spiral depressions 16 on the surface of the ball 10 and separated by un-dimpled surface 14. These spiral depressions 16 depicted herein are atypical of the conventional dimple site 12 that is well known in the industry.

Other embodiments of the invention are shown in FIGS. 2-7 wherein the spiral depressions 16 are on the concave inner surface of a dimple 12, the dimples 12 having at least one spiral depression 16 defined thereon to further agitate or energize the boundary layer flow over the dimples 12 and to reduce the tendency for separation of the turbulent boundary layer around the golf ball in flight. As described below, the dimples 12 may have many shapes and sizes, and the spiral depressions may have many sizes and shapes, as long as they contribute to the agitation of the air flowing over the dimples.

FIGS. 2-7 illustrate spiral depressions 16 disposed on the inner land surface 17 of the dimple 12. As used herein, the inner dimple land surface 17 is the concave surface of the dimple unaffected by the spiral depressions 16. For spherical dimples, the inner land surface 17 is spherical or arcuate, but may also be flat or have any irregular shape known in the art. As taught in U.S. Pat. No. 6,162,136 patent, the circumference of the dimples optimizes the aerodynamic performance of the golf ball. Similarly, the geometry of the spiral depressions 16 also contributes to and improves the aerodynamic of the golf ball. Preferably, the size, radius of turn, distance between turns, and depth of the spiral depressions are selected to minimize paint flooding. The spiral depressions 16 may be clockwise or counterclockwise in direction, and the size (cross-section) of the spiral depressions, may also vary. The depression may be one continuous spiral or it may be multiple spirals as shown in FIG. 1. Also, the cross-section of the spiral may vary throughout the spiral. Advantageously, the spiral depressions of the present invention remedy a design issue known in the art, i.e., minimizing the land surface 14 of the golf ball for better aerodynamics but without increasing the wear and tear on the ball during repeated impacts by the golf clubs. In accordance to the present invention, the aerodynamic performance is increased by increasing the agitation of the boundary layer over the dimpled surfaces, and the un-dimpled surface 14 may remain robust to resist premature wear and tear.

Figure 2:
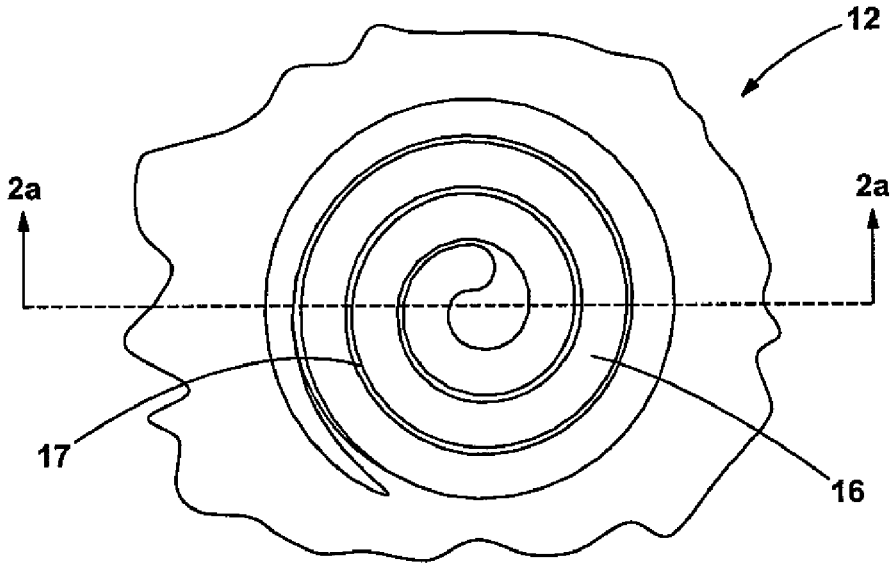
FIG. 2 is a top view of a spiral depression disposed on the inner surface of a dimple in accordance to the present invention.
Figure 2A:
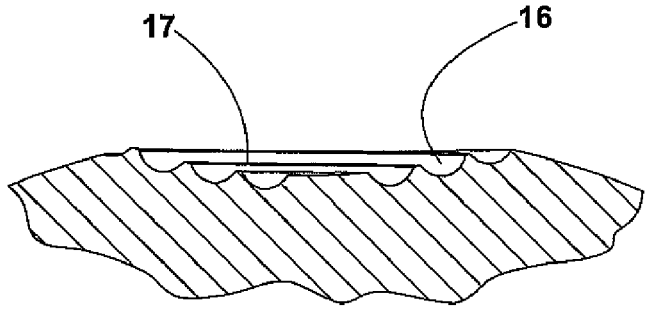
FIG. 2*a* is a cross-section taken along line 2*a*-2*a* of FIG. 2.
Figure 3:
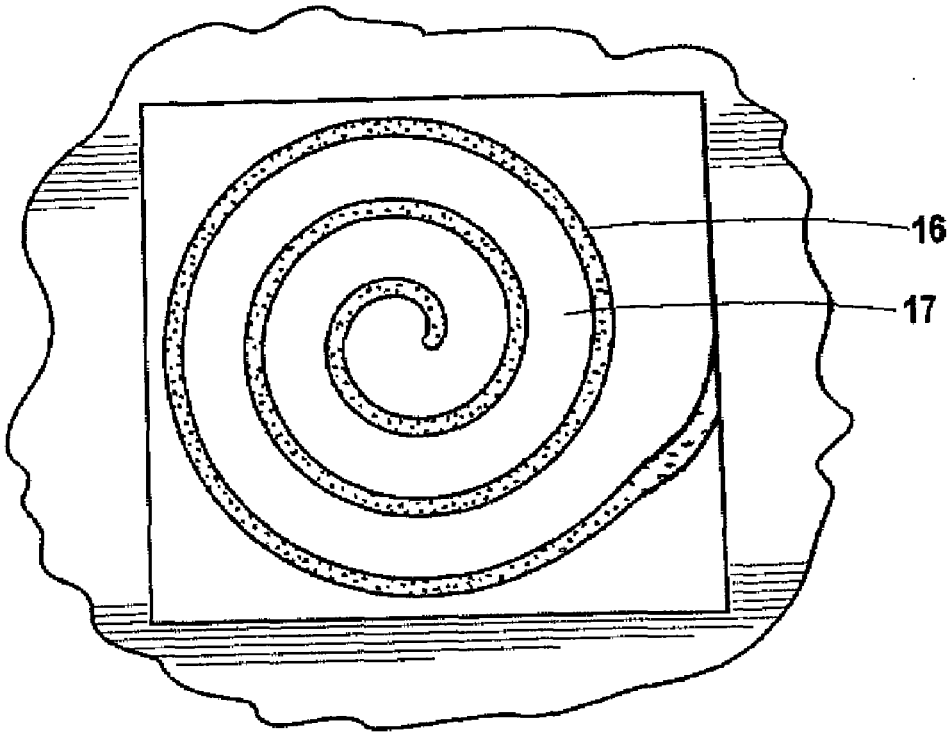
FIG. 3 is a top view of a spiral depression disposed on the inner surface of a square dimple in accordance to the present invention.
Figure 4:
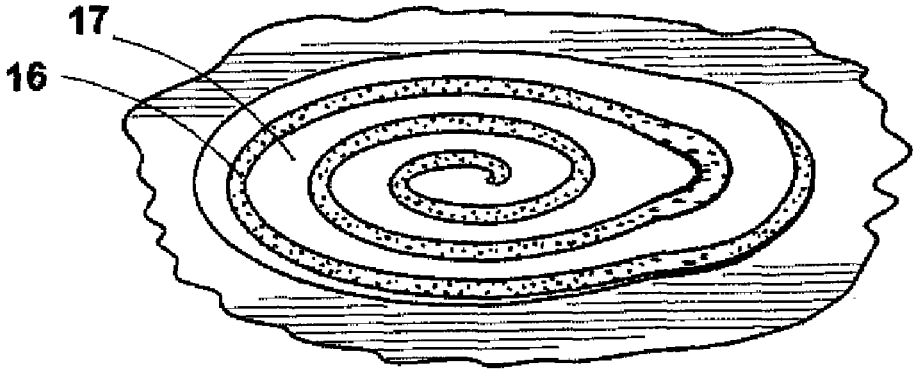
FIG. 4 is a top view of a spiral depression disposed on the inner surface of an elliptical dimple in accordance to the present invention.
Figure 5:
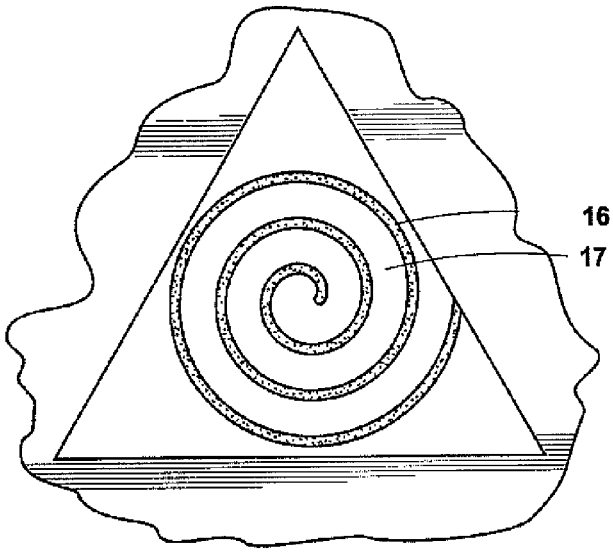
FIG. 5 is a top view of a spiral depression disposed on the inner surface of a circular dimple in accordance to the present invention.
Figure 6:
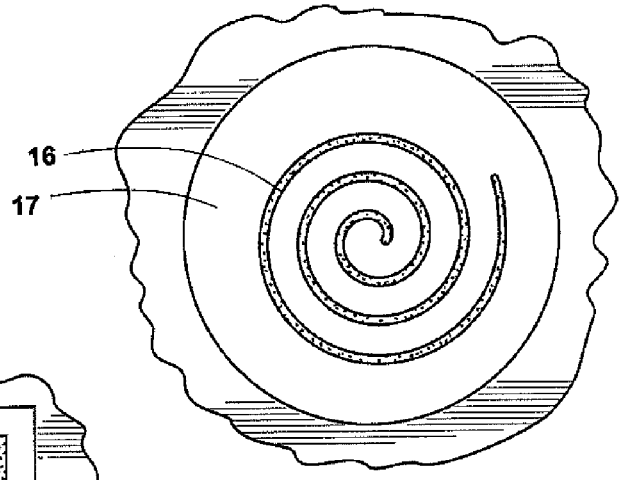
FIG. 6 is a top view of a spiral depression disposed completely inside a circular dimple.
Figure 7:
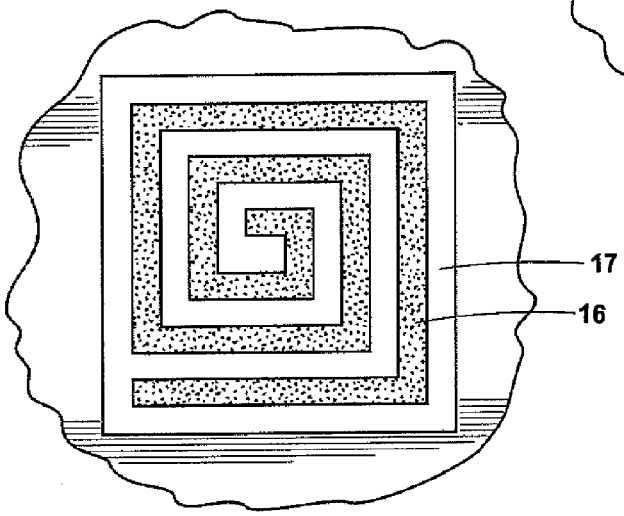
FIG. 7 is a top view of non-circular dimple spiral depression of the present invention.

The spiral depressions 16 can assume a regular pattern, such as a generally circular-like pattern shown in FIGS. 2, 2*a*, 3, 5, and 6, or they may be elliptical as shown in FIG. 4 or straight-lined as shown in FIG. 7. They may encompass the entire area between the perimeters, such as shown in FIGS. 2-5, or they may exist entirely within the dimple, such as shown in FIG. 6. The spirals may also abut or overlap each other, or they may have a substantial inner land surface 17 separating them. The spiral depressions may be in segments creating a plurality of depressions within a single dimple. An advantage of the abutting distribution is that it may produce sharp angles. Sharp angles or other acute shapes are known to delay flow separation over an object in flight. The angles or shapes may be altered by repositioning one or more of the spirals.

While dimples 12 generally have a depth of about 0.010 to 0.020 inch from the un-dimpled surface 14, the concave spiral depressions 16 of the present invention have an outer perimeter (width) of at least 0.180 inch.

FIG. 3 is a variation of the embodiment of FIG. 2. Here, the spiral depression 16 is shown in a square dimple. In FIG. 4, the dimple and corresponding spiral has an elliptical shape. Another variation is shown in FIG. 5, wherein the dimple is of a triangular shape and a spiral depression lies within the perimeter. Yet still another embodiment, shown in FIG. 6, depicts the spiral depression as completely within the inner land surface 17. This same principle may also be adopted for any of the other dimple shapes of FIGS. 2-4.

More preferably, the spiral depressions are suitable for use with golf balls having greater than 60% or most preferably greater than 70% of dimple coverage. It is to be appreciated, that the use of spiral depressions 16, in accordance to the present invention, can advantageously render golf balls with lower percentage of dimple coverage more aerodynamically desirable.

The dimpled golf ball in accordance to the present invention and associated tooling can be manufactured by injection molding, compression molding, stamping, multi-axis machining, electro-discharge machining ("EDM"), chemical etching and hobbing, among others.

While various descriptions of the present invention are described above, it is understood that the various features of the embodiments of the present invention shown herein can be used singly or in combination thereof. This invention is also not to be limited to the specifically preferred embodiments depicted therein.

The invention claimed is:

1. A golf ball comprising:

a substantially spherical surface; and a plurality of polygonal dimples formed on the surface, the dimples comprising a perimeter enclosing an inner land surface, wherein each of the plurality of dimples comprises a spiral depression disposed on the inner land surface.

2. A golf ball comprising:

a substantially spherical surface; and a plurality of triangular dimples formed on the surface, the dimples comprising a perimeter enclosing an inner land surface, wherein each of the plurality of dimples comprises a spiral depression disposed on the inner land surface.

* * * * *